US010926371B2

(12) United States Patent
Xu et al.

(10) Patent No.: US 10,926,371 B2
(45) Date of Patent: Feb. 23, 2021

(54) WHEEL GRINDING DEVICE

(71) Applicant: CITIC Dicastal CO., LTD., Hebei (CN)

(72) Inventors: Zuo Xu, Qinhuangdao (CN); Bowen Xue, Qinhuangdao (CN); Hao Wu, Qinhuangdao (CN); Hongsen Zhang, Qinhuangdao (CN); Jiandong Guo, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 324 days.

(21) Appl. No.: 16/025,868

(22) Filed: Jul. 2, 2018

(65) Prior Publication Data

US 2019/0283200 A1 Sep. 19, 2019

(30) Foreign Application Priority Data

Mar. 19, 2018 (CN) ..... 201810224852.7

(51) Int. Cl.

| | |
|---|---|
| ***B24B 21/00*** | (2006.01) |
| ***B24B 21/02*** | (2006.01) |
| ***B24B 21/16*** | (2006.01) |
| ***B24B 41/02*** | (2006.01) |
| ***B24B 41/06*** | (2012.01) |

(Continued)

(52) U.S. Cl.

CPC ..... *B24B 21/008* (2013.01); *B24B 5/08* (2013.01); *B24B 5/44* (2013.01); *B24B 19/26* (2013.01); *B24B 21/006* (2013.01); *B24B 21/02* (2013.01); *B24B 21/16* (2013.01); *B24B 27/0061* (2013.01); *B24B 27/0076* (2013.01); *B24B 29/005* (2013.01); *B24B 41/02* (2013.01); *B24B 41/067* (2013.01); *B24B 47/12* (2013.01)

(58) Field of Classification Search

CPC ..... B24B 5/44; B24B 21/008; B24B 5/46; B24B 5/08; B24B 19/26; B24B 21/006; B24B 21/02; B24B 21/16; B24B 27/0061; B24B 27/0076; B24B 29/005; B24B 41/02; B24B 41/067; B24B 47/12; B24B 5/047; B24B 5/18; B24B 21/00; B24B 41/06; B24B 21/20; B24B 21/12; B24B 21/14; B24B 13/0043; B24B 25/00; B24B 27/0092; B24B 27/0023; B24B 27/0069; B24B 5/01; B24B 5/06; B24B 19/28; B24B 9/04; B24B 3/46

USPC ..... 451/65, 254, 299, 303

See application file for complete search history.

(56) References Cited

U.S. PATENT DOCUMENTS

2017/0209976 A1* 7/2017 Xue ..... B24B 9/04
2017/0348781 A1* 12/2017 Xue ..... B23D 79/04

(Continued)

OTHER PUBLICATIONS

Supplementary European Search Report in the European application No. 19162857.7, dated Jul. 24, 2019, 5 pgs.

*Primary Examiner* — Monica S Carter
*Assistant Examiner* — Michael A Gump
(74) *Attorney, Agent, or Firm* — Cooper Legal Group, LLC

(57) ABSTRACT

A wheel grinding device consists of a lower lifting rotary system, spoke grinding units, a center hole grinding system and an upper lifting and clamping rotary system. The wheel grinding device not only can be used for grinding the center hole of a wheel of any size via brush units of the center hole grinding system, but also can be used for grinding the back of wheel spokes of different sizes and shapes via the actions of brush belts of the spoke grinding units.

1 Claim, 6 Drawing Sheets

(51) Int. Cl.

| | |
|---|---|
| ***B24B 29/00*** | (2006.01) |
| ***B24B 47/12*** | (2006.01) |
| ***B24B 27/00*** | (2006.01) |
| ***B24B 5/44*** | (2006.01) |
| ***B24B 5/08*** | (2006.01) |
| ***B24B 19/26*** | (2006.01) |

(56) References Cited

U.S. PATENT DOCUMENTS

| | | | | |
|---|---|---|---|---|
| 2017/0348816 | A1* | 12/2017 | Xue | B24B 41/06 |
| 2018/0147685 | A1* | 5/2018 | Xue | B24B 47/12 |
| 2019/0291235 | A1* | 9/2019 | Xue | B24B 29/04 |

* cited by examiner

WHEEL GRINDING DEVICE

CROSS-REFERENCE TO RELATED APPLICATIONS

The present application claims benefit of Chinese Patent Application No. 201810224852.7, filed on Mar. 19, 2018, the contents of which are hereby incorporated by reference in its entirety.

BACKGROUND

In the machining process of an aluminum alloy wheel, burrs are sure to produce on the center hole and the back of spokes. If the burrs are not removed in time, the subsequent coating effect will be seriously affected, and the wheel will be corroded in advance during use. Therefore, a multifunctional and general-purpose automatic grinding device is needed to grind these parts of the wheel so as to achieve the purpose of removing burrs.

SUMMARY

The present disclosure relates to a grinding device, in particular to a device for grinding the center hole of a wheel and the back of spokes.

The object of the present disclosure is to provide a wheel grinding device, which not only can be used for grinding the center hole of a wheel of any size, but also can be used for grinding the back of wheel spokes of different sizes and shapes via the actions of brush belts.

In order to fulfill the above aim, the technical solution of the present disclosure is a wheel grinding device which consists of a frame, lower guide posts, lower guide sleeves, a first servo motor, a lower fixed plate, a first belt pulley, a first synchronous belt, a second belt pulley, a lower lifting plate, a first shaft, a first bearing seat, a partition plate, a lifting sleeve, a first servo electric cylinder, a second servo motor, first racks, first guide rails, vertical plates, first gears, third servo motors, fourth servo motors, transverse plates, second guide rails, transverse sliding plates, second shafts, second bearing seats, rotary racks, fifth servo motors, third belt pulleys, brush belts, fourth belt pulleys, a third bearing seat, a third shaft, a fixed block, a chute, a nut, sliding blocks, springs, a sixth servo motor, clamping jaws, a second gear, second racks, a first cylinder, third guide rails, a left sliding plate, an upper fixed plate, a fourth shaft, a fourth bearing seat, an upper lifting plate, a seventh servo motor, upper guide posts, second cylinders, upper guide sleeves, a right sliding plate, third cylinders, eighth servo motors, third gears, third racks, brush units, etc.

A lower lifting rotary system includes: the two third cylinders and the four lower guide sleeves are all fixed on the lower fixed plate, and the four lower guide posts matched with the lower guide sleeves are fixed below the lower lifting plate; the output ends of the third cylinders are hinged with the lower part of the lower lifting plate; the first bearing seat is fixed above the lower lifting plate, and the first shaft is installed inside the first bearing seat via a bearing; the first belt pulley is fixed below the first shaft; the first servo motor is fixed below the lower lifting plate, and the second belt pulley is fixed at the output end of the first servo motor; and the first belt pulley is connected with the second belt pulley via the first synchronous belt.

A spoke grinding unit includes: the vertical plate is installed on the upper side of the first shaft via the first guide rail; the first rack is also fixed on the upper side of the first shaft; the third servo motor is fixed on the left side of the vertical plate, the first gear is fixed at the output end of the third servo motor, and the first gear is engaged with the first rack; the transverse plate is fixed below the vertical plate; the transverse sliding plate is installed above the transverse plate via the second guide rail; the second bearing seat is fixed above the transverse sliding plate; the second shaft is installed in the middle of the second bearing seat via a bearing; the fourth servo motor is fixed below the transverse sliding plate, and the output end thereof is connected with the lower part of the second shaft; the rotary rack is fixed above the second shaft; the third belt pulley and the fourth belt pulley are installed above the rotary rack and connected with each other via the brush belt; the fifth servo motor is installed on the side of the rotary rack, and the output end thereof is connected with the third belt pulley; the third rack is installed above the transverse plate; the eighth servo motor is fixed on the upper side of the transverse sliding plate, and the third gear is fixed at the output end thereof; and the third gear is engaged with the third rack. This device includes four sets of fully symmetric spoke grinding units.

A center hole grinding system includes: the partition plate is fixed above the middle hole of the first shaft; the lifting sleeve is matched with the inner wall of the hole at the upper part of the first shaft; the first servo electric cylinder is fixed below the partition plate, and the output end thereof is connected with the bottom of the lifting sleeve; the third bearing seat is fixed above a top plate of the lifting sleeve; the third shaft is installed inside the third bearing seat via a bearing; the second servo motor is fixed below the top plate of the lifting sleeve, and the output end thereof is connected with the lower part of the third shaft; the fixed block is fixed above the third shaft; the nut is provided with threads at the upper part and installed inside the fixed block via a bearing; the sixth servo motor is fixed below the fixed block, and the output end thereof is connected with the lower part of the nut; the chute is fixed above the fixed block; the sliding blocks are matched with T-shaped slots in the chute; a plurality of sliding blocks are uniformly distributed in the circumferential direction; the bottoms of the sliding blocks are provided with threads, which are matched with the threads at the upper part of the nut; the brush units are matched with the holes at the upper parts of the sliding blocks; a plurality of springs are installed in the holes at the upper parts of the sliding blocks and each is placed on one side of the brush unit.

An upper lifting and clamping rotary system includes: the second gear is fixed in the middle below the upper fixed plate; the left sliding plate and the right sliding plate are installed below the upper fixed plate via the third guide rails; two clamping jaws are respectively fixed below the left sliding plate and the right sliding plate, and two second racks are respectively fixed above the left sliding plate and the right sliding plate; the two second racks are simultaneously engaged with the second gear; the first cylinder is fixed below the upper fixed plate, and the output end thereof is connected with the upper part of the left sliding plate; the fourth bearing seat is fixed below the upper lifting plate; the fourth shaft is installed inside the fourth bearing seat via a bearing; the lower part of the fourth shaft is connected with the top of the upper fixed plate; the seventh servo motor is fixed above the upper lifting plate, and the output shaft thereof is connected with the upper part of the fourth shaft; the four upper guide posts are fixed above the upper lifting plate; the four upper guide sleeves matched with the upper guide posts are fixed at the top of the frame; the two second cylinders are also fixed at the top of the frame, and the output ends thereof are hinged with the upper end of the upper lifting plate.

In actual use, the second cylinders drive the clamping jaws via the upper guide posts to decline below a roller bed; the first cylinder drives the four clamping jaws via the second gear and the second racks to synchronously clamp a wheel; the seventh servo motor drives the clamped wheel to rotate via the fourth shaft; the third cylinders drive the first shaft and the brush units via the lower guide posts to rise below a wheel flange plate; the first servo electric cylinder accurately adjusts the brush units to appropriate positions via the lifting sleeve; the second servo motor drives the brush units to rotate via the third shaft, and the rotating direction is opposite to that of the wheel; the sixth servo motor adjusts the position of each sliding block via the nut to fit with the size of the center hole of the wheel; the brush units are in a floating state via the springs to completely contact the center hole of the wheel, and the center hole is ground at the moment; the fifth servo motors drive the brush belts to rotate via the third belt pulleys and the fourth belt pulleys; the fourth servo motors drive the brush belts to rotate circumferentially via the second shafts; the eighth servo motors can adjust the left and right positions of the brush belts via the third gears, the third racks and the second guide rails; the third servo motors can adjust the upper and lower positions of the brush belts via the first gears, the first racks and the first guide rails; and when the rotating brush belts contact the back of the wheel spokes, the back of the wheel spokes can be ground.

The wheel grinding device of the present disclosure not only can be used for grinding the center hole of a wheel of any size, but also can be used for grinding the back of wheel spokes of different sizes and shapes via the actions of brush belts, and at the same time, has the characteristics of high automation, high removal efficiency, advanced technology, strong versatility and high safety and stability.

LIST OF REFERENCE SYMBOLS

Figure 1:
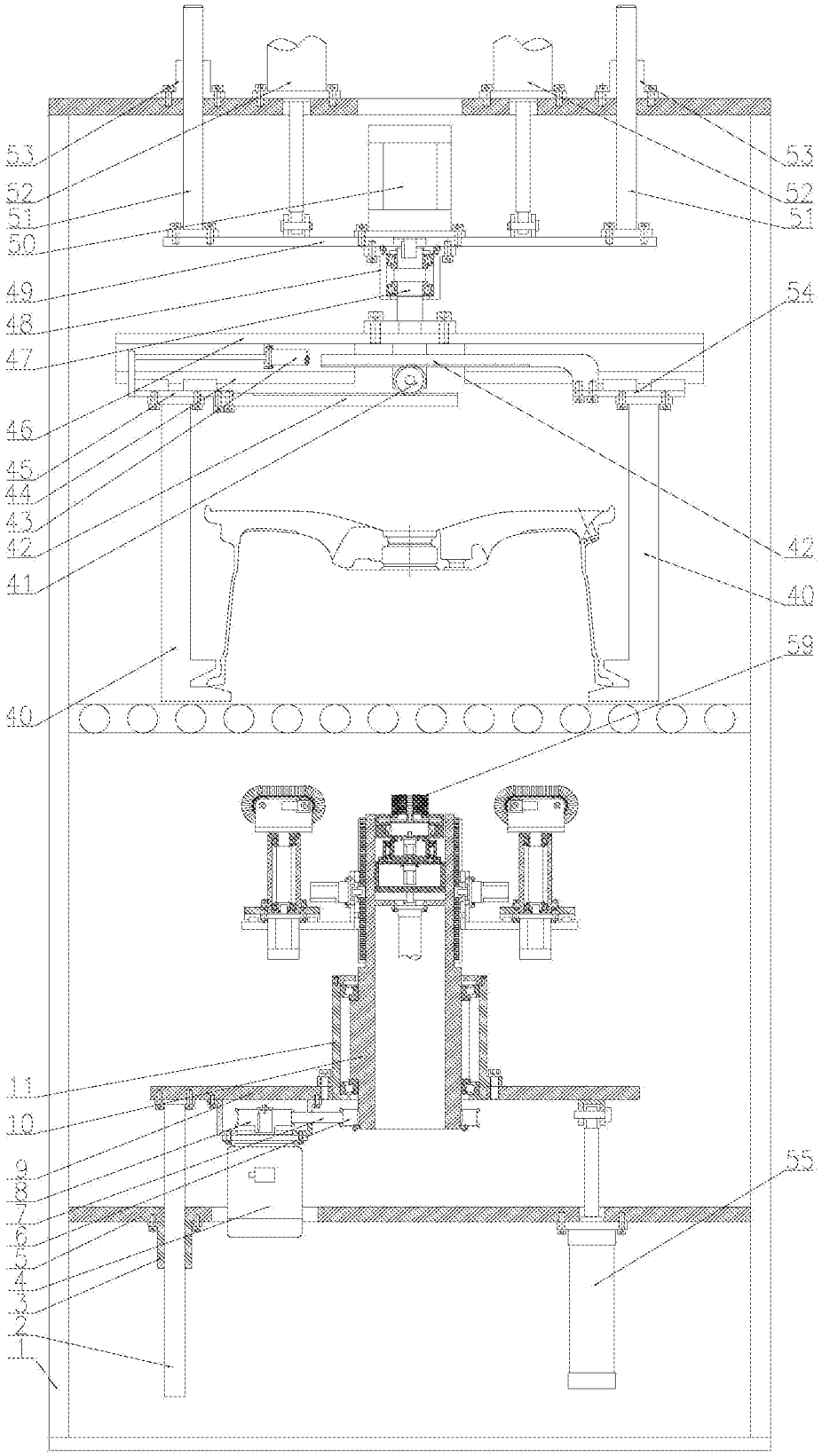
FIG. 1 is a front view of a wheel grinding device according to the present disclosure.
Figure 2:
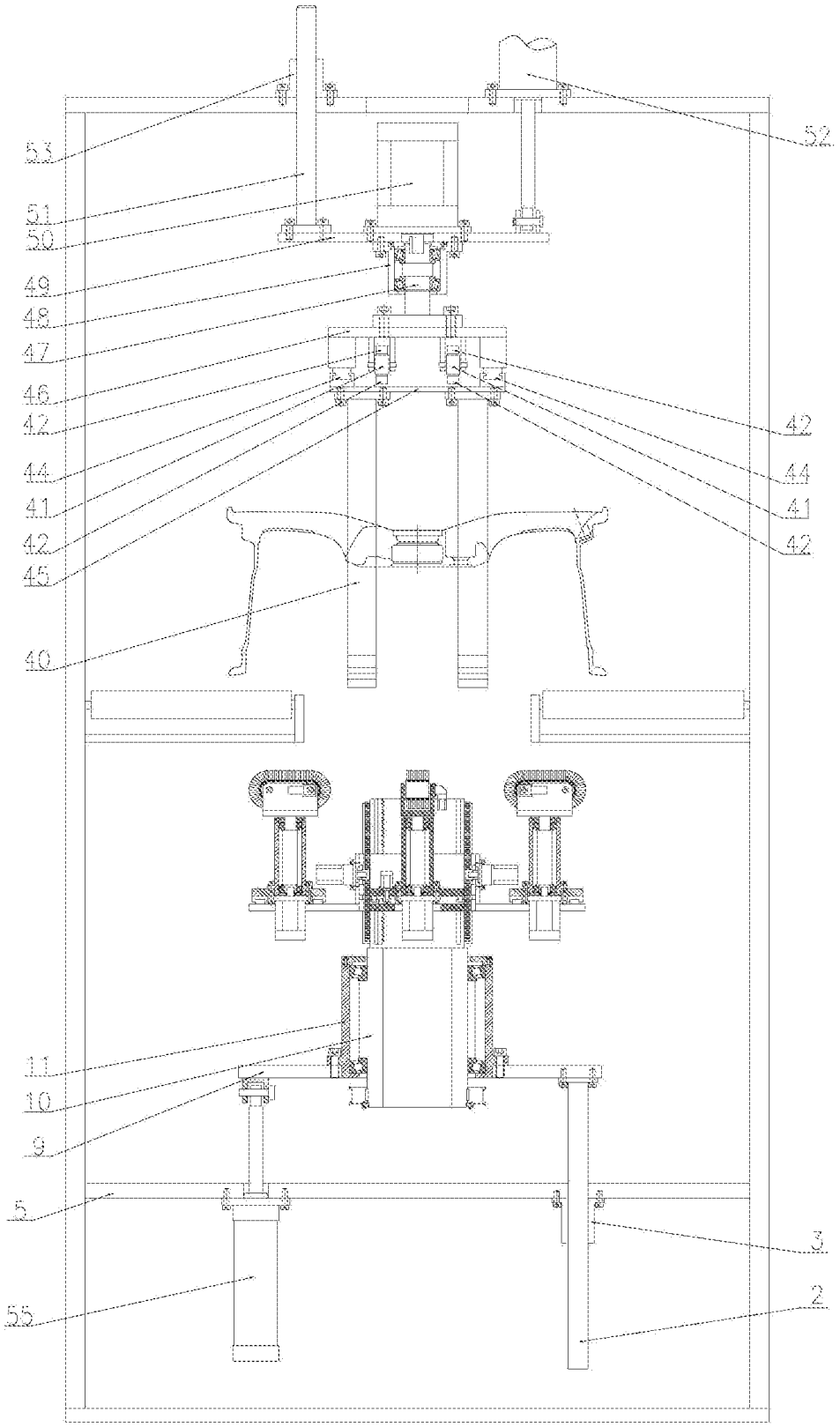
FIG. 2 is a left view of the wheel grinding device according to the present disclosure.
Figure 3:
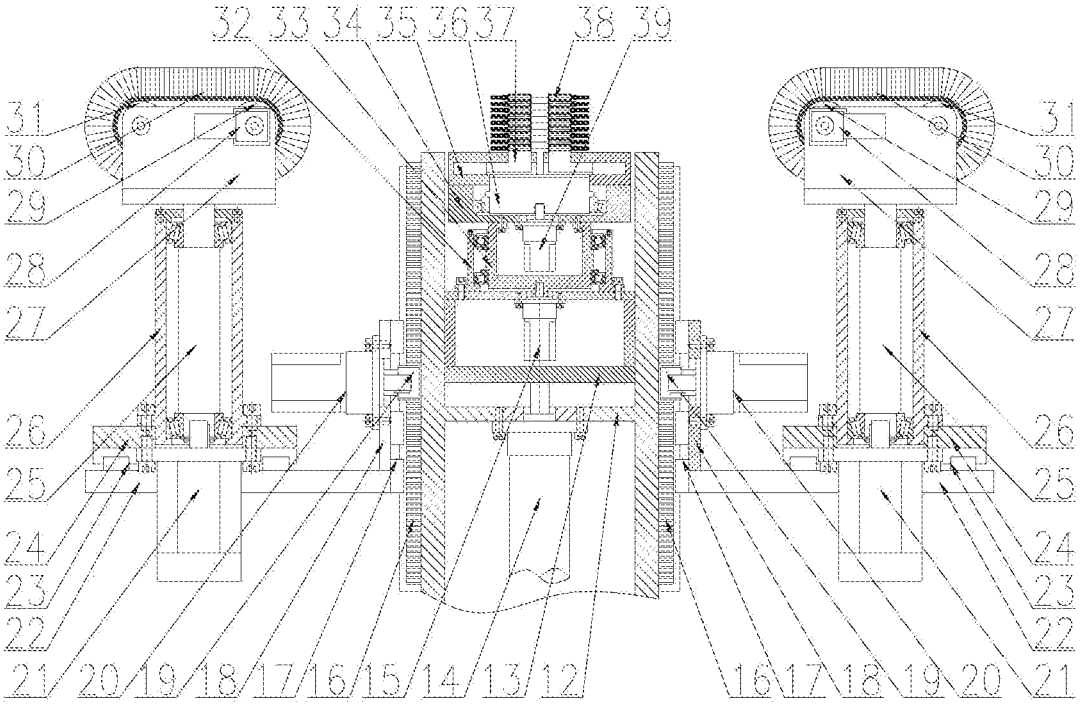
FIG. 3 is a partial front view of the wheel grinding device according to the present disclosure.
Figure 4:
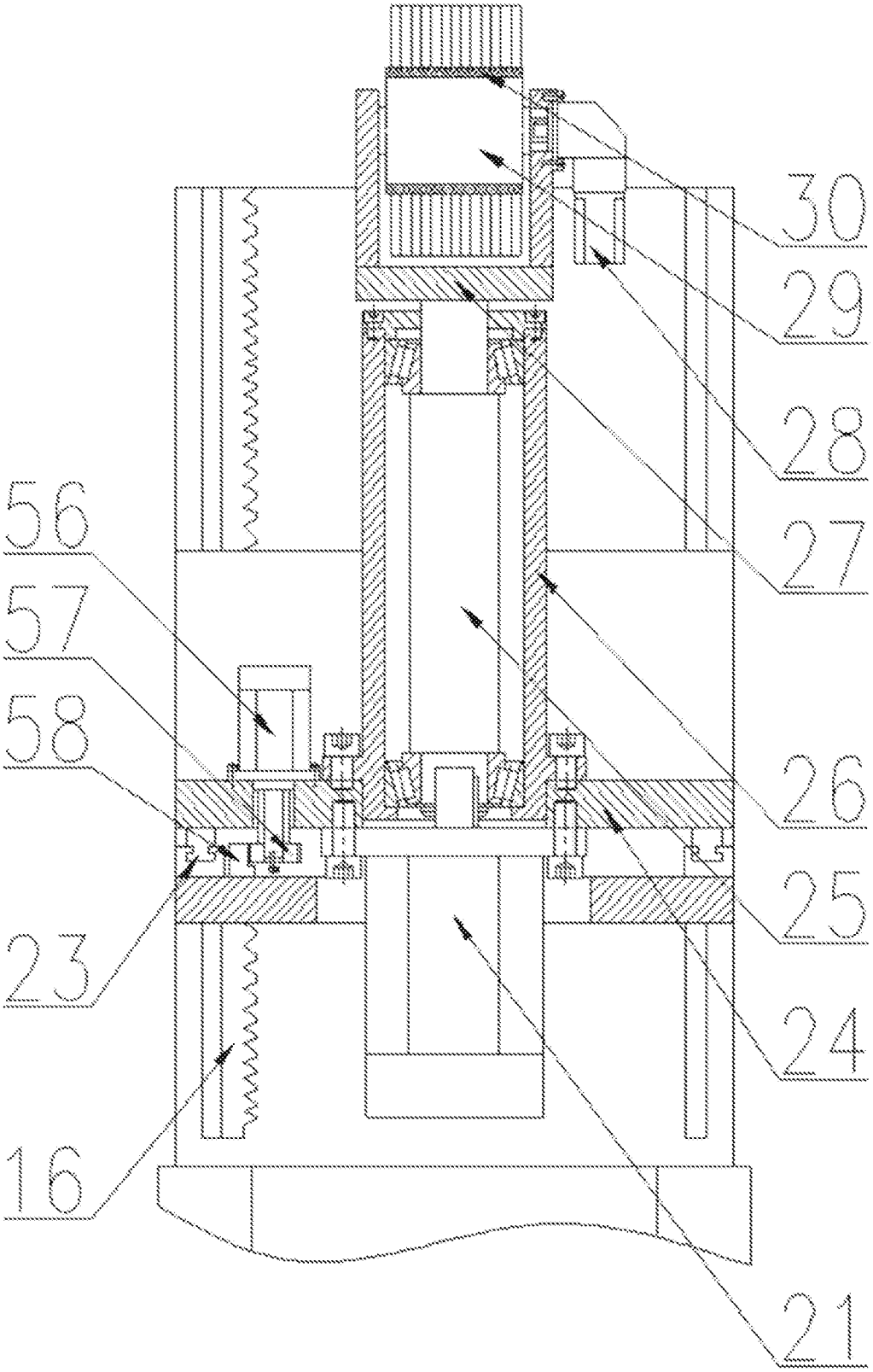
FIG. 4 is a partial left view of the wheel grinding device according to the present disclosure.
Figure 5:
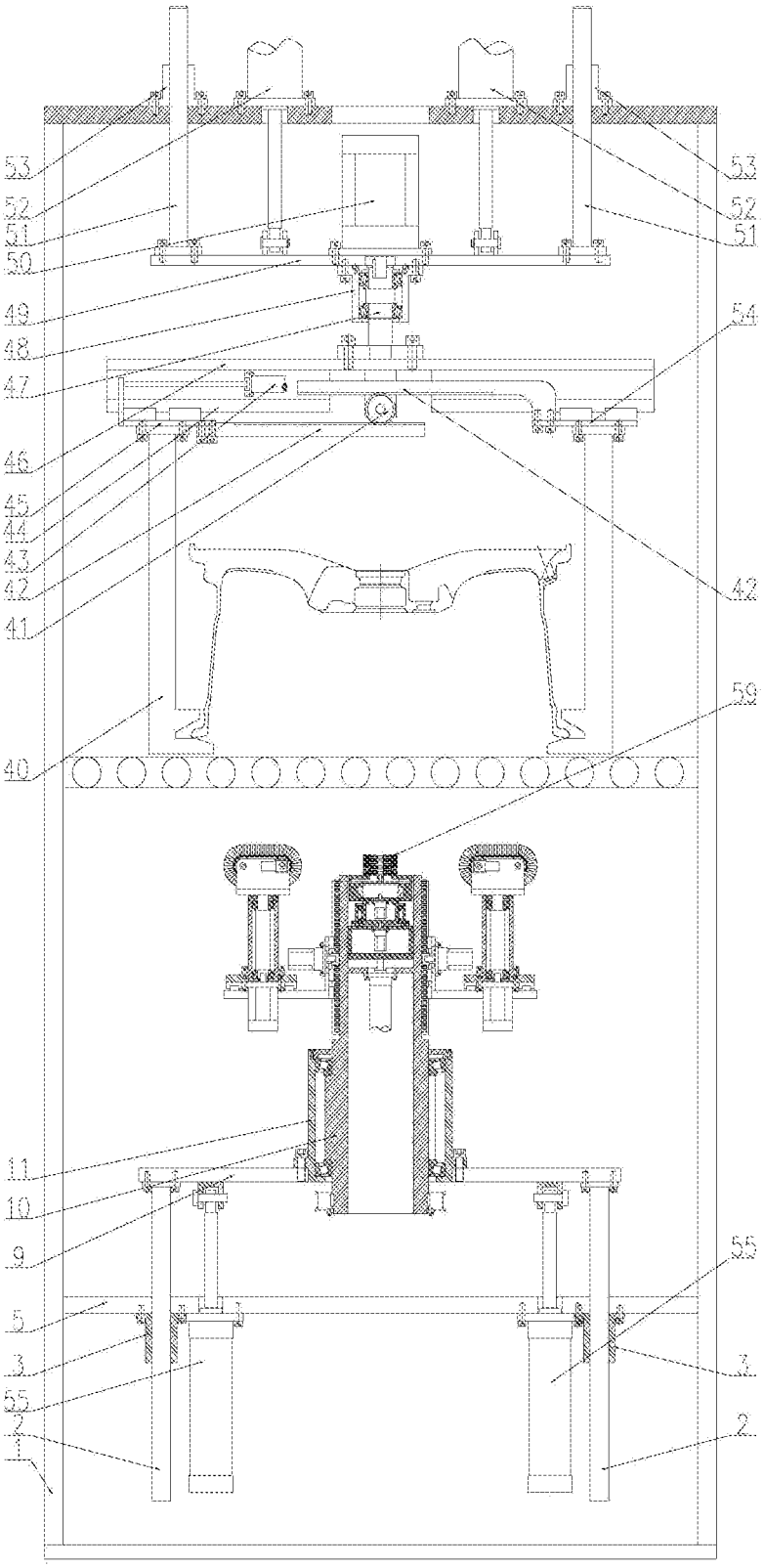
FIG. 5 is a front view of the wheel grinding device according to the present disclosure in which two third cylinders are shown.
Figure 6:
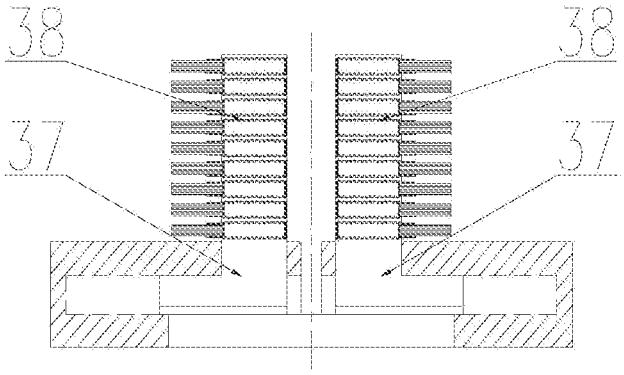
FIG. 6 is a partial side view of the wheel grinding device according to the present disclosure.

1 frame
2 lower guide post
3 lower guide sleeve
4 first servo motor
5 lower fixed plate
6 first belt pulley
7 first synchronous belt
8 second belt pulley
9 lower lifting plate
10 first shaft
11 first bearing seat
12 partition plate
13 lifting sleeve
14 first servo electric cylinder
15 second servo motor
16 first rack
17 first guide rail
18 vertical plate
19 first gear
20 third servo motor
21 fourth servo motor
22 transverse plate
23 second guide rail
24 transverse sliding plate
25 second shaft
26 second bearing seat
27 rotary rack
28 fifth servo motor
29 third belt pulley
30 brush belt
31 fourth belt pulley
32 third bearing seat
33 third shaft
34 fixed block
35 chute
36 nut
37 sliding block
38 spring
39 sixth servo motor
40 clamping jaw
41 second gear
42 second rack
43 first cylinder
44 third guide rail
45 left sliding plate
46 upper fixed plate
47 fourth shaft
48 fourth bearing seat
49 upper lifting plate
50 seventh servo motor
51 upper guide post
52 second cylinder
53 upper guide sleeve
54 right sliding plate
55 third cylinder
56 eighth servo motor
57 third gear
58 third rack
59 brush unit

DETAILED DESCRIPTION

The details and working conditions of the specific device according to the present disclosure will be described below in combination with the drawings.

The device consists of a frame 1, lower guide posts 2, lower guide sleeves 3, a first servo motor 4, a lower fixed plate 5, a first belt pulley 6, a first synchronous belt 7, a second belt pulley 8, a lower lifting plate 9, a first shaft 10, a first bearing seat 11, a partition plate 12, a lifting sleeve 13, a first servo electric cylinder 14, a second servo motor 15, first racks 16, first guide rails 17, vertical plates 18, first gears 19, third servo motors 20, fourth servo motors 21, transverse plates 22, second guide rails 23, transverse sliding plates 24, second shafts 25, second bearing seats 26, rotary racks 27, fifth servo motors 28, third belt pulleys 29, brush belts 30, fourth belt pulleys 31, a third bearing seat 32, a third shaft 33, a fixed block 34, a chute 35, a nut 36, sliding blocks 37, springs 38, a sixth servo motor 39, clamping jaws 40, a second gear 41, second racks 42, a first cylinder 43, third guide rails 44, a left sliding plate 45, an upper fixed plate 46, a fourth shaft 47, a fourth bearing seat 48, an upper lifting plate 49, a seventh servo motor 50, upper guide posts 51, second cylinders 52, upper guide sleeves 53, a right sliding plate 54, third cylinders 55, eighth servo motors 56, third gears 57, third racks 58, brush units 59, etc.

A lower lifting rotary system includes: the two third cylinders 55 and the four lower guide sleeves 3 are all fixed on the lower fixed plate 5, and the four lower guide posts 2 matched with the lower guide sleeves 3 are fixed below the lower lifting plate 9; the output ends of the third cylinders 55 are hinged with the lower part of the lower lifting plate 9; the first bearing seat 11 is fixed above the lower lifting plate 9, and the first shaft 10 is installed inside the first bearing seat 11 via a bearing; the first belt pulley 6 is fixed below the first shaft 10; the first servo motor 4 is fixed below the lower lifting plate 9, and the second belt pulley 8 is fixed at the output end of the first servo motor 4; and the first belt pulley 6 is connected with the second belt pulley 8 via the first synchronous belt 7.

A spoke grinding unit includes: the vertical plate 18 is installed on the upper side of the first shaft 10 via the first guide rail 17; the first rack 16 is also fixed on the upper side of the first shaft 10; the third servo motor 20 is fixed on the left side of the vertical plate 18, the first gear 19 is fixed at the output end of the third servo motor 20, and the first gear 19 is engaged with the first rack 16; the transverse plate 22 is fixed below the vertical plate 18; the transverse sliding plate 24 is installed above the transverse plate 22 via the second guide rail 23; the second bearing seat 26 is fixed above the transverse sliding plate 24; the second shaft 25 is installed in the middle of the second bearing seat 26 via a bearing; the fourth servo motor 21 is fixed below the transverse sliding plate 24, and the output end thereof is connected with the lower part of the second shaft 25; the rotary rack 27 is fixed above the second shaft 25; the third belt pulley 29 and the fourth belt pulley 31 are installed above the rotary rack 27 and connected with each other via the brush belt 30; the fifth servo motor 28 is installed on the side of the rotary rack 27, and the output end thereof is connected with the third belt pulley 29; the third rack 58 is installed above the transverse plate 22; the eighth servo motor 56 is fixed on the upper side of the transverse sliding plate 24, and the third gear 57 is fixed at the output end thereof; and the third gear 57 is engaged with the third rack 58. This device includes four sets of fully symmetric spoke grinding units.

A center hole grinding system includes: the partition plate 12 is fixed above the middle hole of the first shaft 10; the lifting sleeve 13 is matched with the inner wall of the hole at the upper part of the first shaft 10; the first servo electric cylinder 14 is fixed below the partition plate 12, and the output end thereof is connected with the bottom of the lifting sleeve 13; the third bearing seat 32 is fixed above a top plate of the lifting sleeve 13; the third shaft 33 is installed inside the third bearing seat 32 via a bearing; the second servo motor 15 is fixed below the top plate of the lifting sleeve 13, and the output end thereof is connected with the lower part of the third shaft 33; the fixed block 34 is fixed above the third shaft 33; the nut 36 is provided with threads at the upper part and installed inside the fixed block 34 via a bearing; the sixth servo motor 39 is fixed below the fixed block 34, and the output end thereof is connected with the lower part of the nut 36; the chute 35 is fixed above the fixed block 34; the sliding blocks 37 are matched with T-shaped slots in the chute 35; a plurality of sliding blocks 37 are uniformly distributed in the circumferential direction; the bottoms of the sliding blocks 37 are provided with threads, which are matched with the threads at the upper part of the nut 36; the brush units 59 are matched with the holes at the upper parts of the sliding blocks 37; a plurality of springs 38 are installed in the holes at the upper parts of the sliding blocks 37 and each is placed on one side of the brush unit 59.

An upper lifting and clamping rotary system includes: the second gear 41 is fixed in the middle below the upper fixed plate 46; the left sliding plate 45 and the right sliding plate 54 are installed below the upper fixed plate 46 via the third guide rails 44; two clamping jaws 40 are respectively fixed below the left sliding plate 45 and the right sliding plate 54, and two second racks 42 are respectively fixed above the left sliding plate 45 and the right sliding plate 54; the two second racks 42 are simultaneously engaged with the second gear 41; the first cylinder 43 is fixed below the upper fixed plate 46, and the output end thereof is connected with the upper part of the left sliding plate 45; the fourth bearing seat 48 is fixed below the upper lifting plate 49; the fourth shaft 47 is installed inside the fourth bearing seat 48 via a bearing; the lower part of the fourth shaft 47 is connected with the top of the upper fixed plate 46; the seventh servo motor 50 is fixed above the upper lifting plate 49, and the output shaft thereof is connected with the upper part of the fourth shaft 47; the four upper guide posts 51 are fixed above the upper lifting plate 49; the four upper guide sleeves 53 matched with the upper guide posts 51 are fixed at the top of the frame 1; the two second cylinders 52 are also fixed at the top of the frame 1, and the output ends thereof are hinged with the upper end of the upper lifting plate 49.

The invention claimed is:

1. A wheel grinding device comprising a lower lifting rotary system, four spoke grinding units, a center hole grinding system and an upper lifting and clamping rotary system, wherein:

the lower lifting rotary system includes: two third cylinders and four lower guide sleeves all fixed on a lower fixed plate, and four lower guide posts fixed below a lower lifting plate, wherein each of the four lower guide posts is matched with a respective one of the four lower guide sleeves; output ends of the two third cylinders are hinged with a lower part of the lower lifting plate; a first bearing seat is fixed above the lower lifting plate, and a first shaft is installed inside the first bearing seat via a first bearing; a first belt pulley is fixed below the first shaft; a first servo motor is fixed below the lower lifting plate, and a second belt pulley is fixed at an output end of the first servo motor; and the first belt pulley is connected with the second belt pulley via a first synchronous belt;

each of the four spoke grinding units includes: a vertical plate installed on an upper side of the first shaft via a first guide rail; a first rack is also fixed on the upper side of the first shaft; a third servo motor is fixed on a left side of the vertical plate, a first gear is fixed at an output end of the third servo motor, and the first gear is engaged with the first rack; a transverse plate is fixed below the vertical plate; a transverse sliding plate is installed above the transverse plate via a second guide rail; a second bearing seat is fixed above the transverse sliding plate; a second shaft is installed in a middle of the second bearing seat via a second bearing; a fourth servo motor is fixed below the transverse sliding plate, and an output end of the fourth servo motor is connected with a lower part of the second shaft; a rotary rack is fixed above the second shaft; a third belt pulley and a fourth belt pulley are installed above the rotary rack and connected with each other via a brush belt; a fifth servo motor is installed on a side of the rotary rack, and an output end of the fifth servo motor is connected with the third belt pulley; a third rack is installed above the transverse plate; an eighth servo motor is fixed on an upper side of the transverse sliding plate, and a third gear is fixed at an output end of the eighth servo motor; and the third gear is engaged with the third rack; wherein the four spoke grinding units are fully symmetric;

the center hole grinding system includes: a partition plate fixed above a middle hole of the first shaft; a lifting sleeve is matched with an inner wall of a hole at an upper part of the first shaft; a first servo electric cylinder is fixed below the partition plate, and an output end of the first servo electric cylinder is connected with a bottom of the lifting sleeve; a third bearing seat is fixed above a top plate of the lifting sleeve; a third shaft is installed inside the third bearing seat via a third bearing; a second servo motor is fixed below the top plate of the lifting sleeve, and an output end of the second servo motor is connected with a lower part of the third shaft; a fixed block is fixed above the third shaft; a nut is provided with threads at an upper part of the nut and installed inside the fixed block via a fourth bearing; a sixth servo motor is fixed below the fixed block, and an output end of the sixth servo motor is connected with a lower part of the nut; a chute is fixed above the fixed block; four sliding blocks are matched with T-shaped slots in the chute; the four sliding blocks are uniformly distributed in a circumferential direction; bottoms of the four sliding blocks are provided with threads, which are matched with the threads at the upper part of the nut; brush units are matched with holes at upper parts of the four sliding blocks; a plurality of springs are installed in the holes at the upper parts of the four sliding blocks and each of the plurality of springs is placed on one side of a corresponding brush unit of the brush units;

the upper lifting and clamping rotary system includes: a second gear fixed in a middle below an upper fixed plate; a left sliding plate and a right sliding plate are installed below the upper fixed plate via two third guide rails; two clamping jaws are respectively fixed below the left sliding plate and the right sliding plate, and two second racks area respectively fixed above the left sliding plate and the right sliding plate; the two second racks are simultaneously engaged with the second gear; a first cylinder is fixed below the upper fixed plate, and an output end of the first cylinder is connected with an upper part of the left sliding plate; a fourth bearing seat is fixed below an upper lifting plate; a fourth shaft is installed inside the fourth bearing seat via a fifth bearing; a lower part of the fourth shaft is connected with a top of the upper fixed plate; a seventh servo motor is fixed above the upper lifting plate, and an output shaft of the seventh servo motor is connected with an upper part of the fourth shaft; four upper guide posts are fixed above the upper lifting plate; four upper guide sleeves are fixed at a top of a frame, wherein each of the four upper guide sleeves is matched with a respective one of the four upper guide posts; two second cylinders are also fixed at the top of the frame, and output ends of the two second cylinders are hinged with an upper end of the upper lifting plate.

* * * * *